US006523370B1

(12) United States Patent
Broker et al.

(10) Patent No.: US 6,523,370 B1
(45) Date of Patent: Feb. 25, 2003

(54) HOSE REVERSAL DETECTION SYSTEM FOR A WASHING MACHINE

(75) Inventors: John F. Broker, Colfax, IA (US); Evan R. Vande Haar, Pella, IA (US)

(73) Assignee: Maytag Corporation, Newton, IA (US)

( * ) Notice: Subject to any disclaimer, the term of this patent is extended or adjusted under 35 U.S.C. 154(b) by 5 days.

(21) Appl. No.: 09/956,905

(22) Filed: Sep. 21, 2001

(51) Int. Cl.[7] ..... D06F 33/00; D06F 39/04
(52) U.S. Cl. ..... 68/12.21; 137/551
(58) Field of Search ..... 236/12.12, 12.11; 68/12.21, 12.22; 4/676; 137/551

(56) References Cited

U.S. PATENT DOCUMENTS 4,406,401 A 9/1983 Nettro ..... 236/12.12
4,528,709 A 7/1985 Getz et al. ..... 8/158
5,299,340 A * 4/1994 Moon ..... 8/158
6,255,952 B1 * 7/2001 Jang ..... 340/588

* cited by examiner

*Primary Examiner*—William Wayner
(74) *Attorney, Agent, or Firm*—Diederiks & Whitelaw, PLC

(57) ABSTRACT

A system for detecting the relative attachment of hot and cold inlet water hoses to a washing machine monitors the temperature of at least one of the hot and cold water inputs to determine if the temperature is increasing or decreasing. Once the hoses.are correctly identified, this information is stored in permanent memory of the machine. This stored information is preferably checked during subsequent cold fill operations.

20 Claims, 3 Drawing Sheets

HOSE REVERSAL DETECTION SYSTEM FOR A WASHING MACHINE

BACKGROUND OF THE INVENTION

1. Field of the Invention

The present invention pertains to the art of laundry appliances and, more particularly, to a system for detecting the relative attachment of hot and cold inlet water hoses to a washing machine.

2. Discussion of the Prior Art

When initially installing a washing machine, it is necessary to connect water inlet hoses to hot and cold water supply lines. Since a washing machine can be utilized in a wide range of water temperature settings, typically based on at least hot, cold and warm temperature selections, the ability of the machine to accurately establish the desired wash temperature can be severely compromised if the inlet hoses are inadvertently connected to the inlet water lines in reverse. That is, if the cold inlet hose is attached to the hot water supply and the hot inlet hose is attached to the cold water supply, establishing a desired wash water temperature can be impossible.

To address this problem, it has heretofore been proposed to incorporate a temperature sensor in each of the inlet flow paths to a washing machine in order to sense a temperature of each inlet stream. Based on these sensed temperatures, the proportion of each of the streams needed to be admitted into the machine in order to establish the desired temperature is calculated and valves associated with each of the inlet streams are correspondingly controlled. In this sense, the actual hook-up arrangement is irrelevant since the temperatures for the streams are separately calculated and utilized in establishing the resulting inlet water stream. Examples of such known arrangements are represented by the disclosures in U.S. Pat. Nos. 4,406,401 and 4,528,709.

With such known systems, multiple temperature sensors are needed. Obviously, this adds to the associated cost and complexity of the system. In addition, the sensed temperatures are keyed to absolute values. That is, the established water supply is calculated based on absolute values of the temperatures sensed from the two water supplies. This reliance on directly sensed water temperatures is considered to be less than desirable for various reasons. For instance, the actual temperature of one or more of the water supplies can vary significantly from the beginning to end of a fill operation or between fill operations. Even if the temperature was continually taken, the response of such known temperature sensors is considered to be too slow to assure an accurate fill temperature. This problem is heightened in situations wherein a relatively low amount of fill water is needed for a desired washing operation.

For at least the reasons presented above, there exists a need in the art for an improved system for detecting the relative attachment of hot and cold inlet water hoses to a washing machine in order that an accurate fill temperature can be established for a desired washing operation selected by a user of the machine. In addition, there exists a need for a system of the type discussed above which will determine the actual hose hook-up arrangement and store this information for future use, while also verifying the status of the hook-up for subsequent washing operations.

SUMMARY OF THE INVENTION

The present invention is directed to a system for detecting the relative attachment of hot and cold inlet water hoses to a washing machine. In accordance with the invention, the temperature of at least one of the hot and cold water inputs is monitored to determine if the temperature is increasing or decreasing. Once the hoses are correctly identified, this information is stored in permanent memory of the machine. This stored information is preferably checked during subsequent washing operations, preferably during any cold fill.

In accordance with the most preferred embodiment of the invention, an initial temperature reading is taken. Thereafter, the cold water valve is opened. After a predetermined time period has elapsed, the inlet water temperature reading is taken. It is then determined whether this inlet temperature is greater than each of a preset temperature and the initial temperature. If either of these determinations is not met, another inlet temperature reading is taken after waiting an additional time period. This cycle continues until the inlet temperature reading meets both of these requirements.

In the next stage, the hot water valve is opened and the cold water valve is closed. A new initial temperature reading is taken and saved as a switchpoint temperature. After waiting a predetermined time period, an inlet temperature is taken. Thereafter, it is determined whether the inlet temperature is less than the switchpoint temperature minus a predetermined temperature value, such as ten degrees Fahrenheit. If a less than determination is reached, the established hot and cold water valve designations are reversed and saved in memory. On the other hand, if a less than determination is not reached, a determination is made as to whether the inlet temperature is greater than the switchpoint temperature plus the predetermined temperature value. If the answer is no, then a new inlet temperature reading is taken after a time delay. This new inlet temperature reading is again sensed and compared to the switchpoint temperature in the manner set forth above. This sequence continues until one of the "less than" or "greater than" determinations is reached. If the inlet temperature is determined to be greater than the switchpoint temperature plus the predetermined temperature value, it is realized that the wrong valve is on such that the cold valve is again opened and the hot valve closed.

This information is preferably checked periodically. In accordance with the most preferred form of the invention, the information is checked every cycle that has a cold fill. In any event, additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
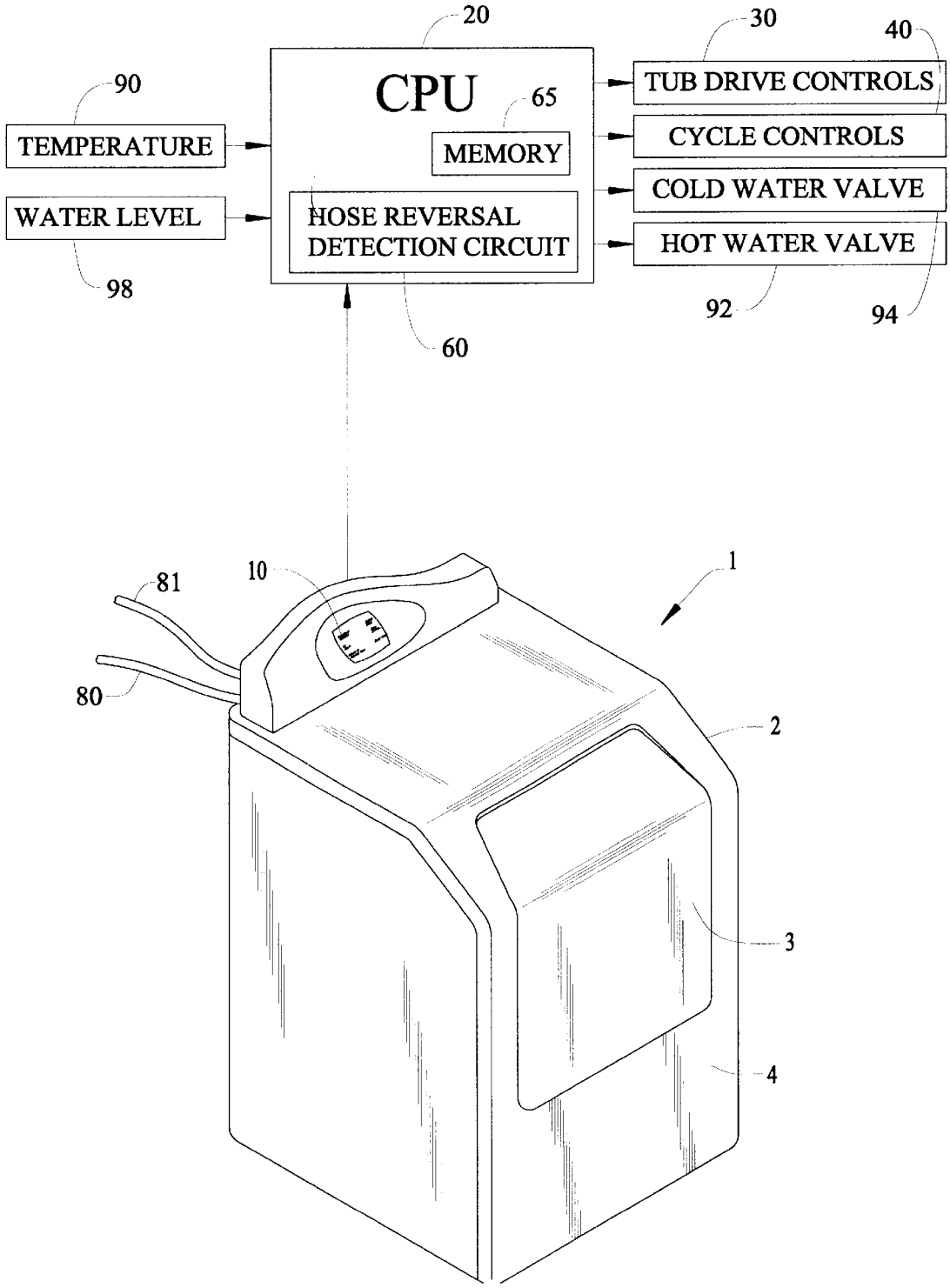
FIG. 1 illustrates a clothes washing machine and schematic control system employed therein in accordance with the invention.

With initial reference to FIG. 1, a washing machine incorporating the hose reversal detection system of the invention is generally indicated at 1. In general, washing machine 1 constitutes a horizontal axis or tumble-type washing machine including a cabinet 2 having a door 3 provided in a front face 4. In a manner known in the art, door 3 can be pivoted to selectively access an inner tub or wash basket (not shown) for clothes to be laundered. In the embodiment depicted, washing machine 1 is adapted to be programmed for a desired washing operation through a touch screen display 10. As will become more fully evident below, the particular construction of washing machine 1 can significantly vary in accordance with the present invention. In the preferred embodiment shown, display 10 includes a plurality of selectable control areas or zones which can be accessed by a user to both program and operate washing machine 1. In the most preferred form of the invention, display 10 takes the form of an LCD display, such as a 128×96 dot matrix, touch screen display, which enables a user to readily review displayed data, preferably in alpha or word text format, and select from that data to establish and begin a desired washing operation. Display 10 could have the selectable areas 15 at any location on the display. The manner in which washing machine 1 can be programmed is disclosed in U.S. patent application Ser. No. 09/741,067 entitled "Interactive Control System for a Laundry Appliance", filed on Dec. 21, 2000 and incorporated herein by reference.

Since these programming aspects of washing machine 1 is not considered part of the present invention, they will not be further described here. However, in general, washing machine 1 incorporates a central processing unit or CPU 20 which is adapted to receive inputs from a user through display 10 and to output signals to both tub drive controls 30 and cycle controls 40 to establish a desired washing operation. Again, this structure is known in the art for use in controlling a normal washing operation for automatic washing machine 1. However, in accordance with the present invention, CPU 20 also includes a hose reversal detection circuit 60 and memory 65 for use in connection with determining and storing information concerning the attachment arrangement of hot and cold water supplies through hoses 80 and 81 to washing machine 1. The flow of inlet water through hoses 80 and 81 are preferably regulated by the opening and closing of respective water valves 92 and 94.

In connection with the detection system of the present invention, washing machine 1 also includes a temperature sensor 90 used to sense the temperature of water being supplied for the selected washing operation. In a manner known in the art, hoses 80 and 81 are connected to a mixing unit (not shown) that generally takes the form of a Y-type connector having two inlets for the hot and cold water hoses 80 and 81 respectively and a single outlet. It is in this single outlet that temperature sensor 90 preferably extends for the purpose of taking inlet water temperature readings. However, as will become more fully apparent below, temperature sensor 90, which is preferably defined by a thermistor, could be arrangement in other portions of washing machine 1, such as in a lower outer tub portion, without departing from the invention. Finally, FIG. 1 also depicts the presence of a water level sensor 98 which is linked to CPU 20. In a manner known in the art, water level sensor 98 is used to signal CPU 20 when hot and cold water valves 92 and 94 need to be turned off based on a desired wash fill level as selected by the user of washing machine 1.

Figure 2A:
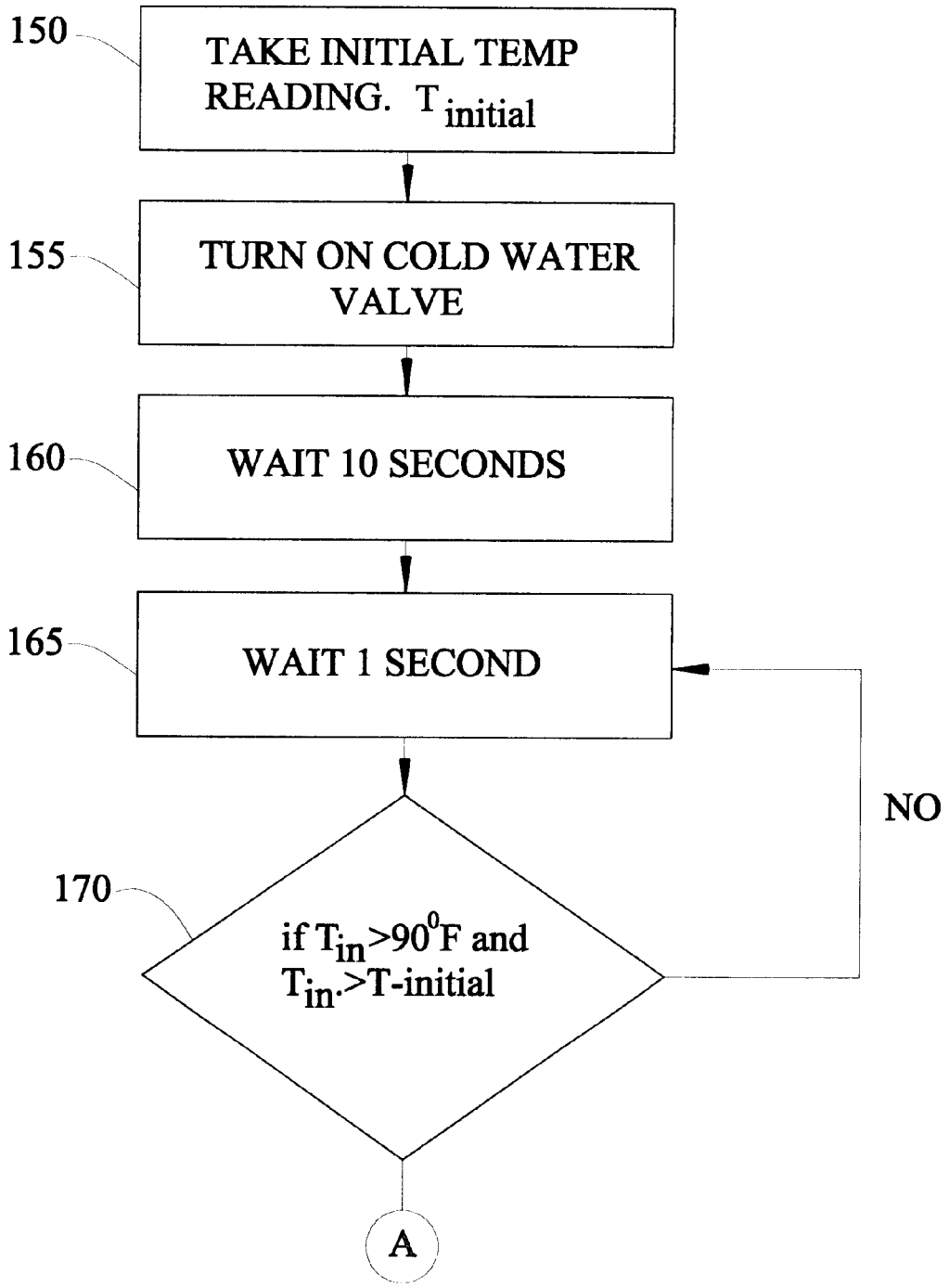
FIG. 2 represents a control algorithm utilized in accordance with the preferred embodiment of the invention.
Figure 2B:
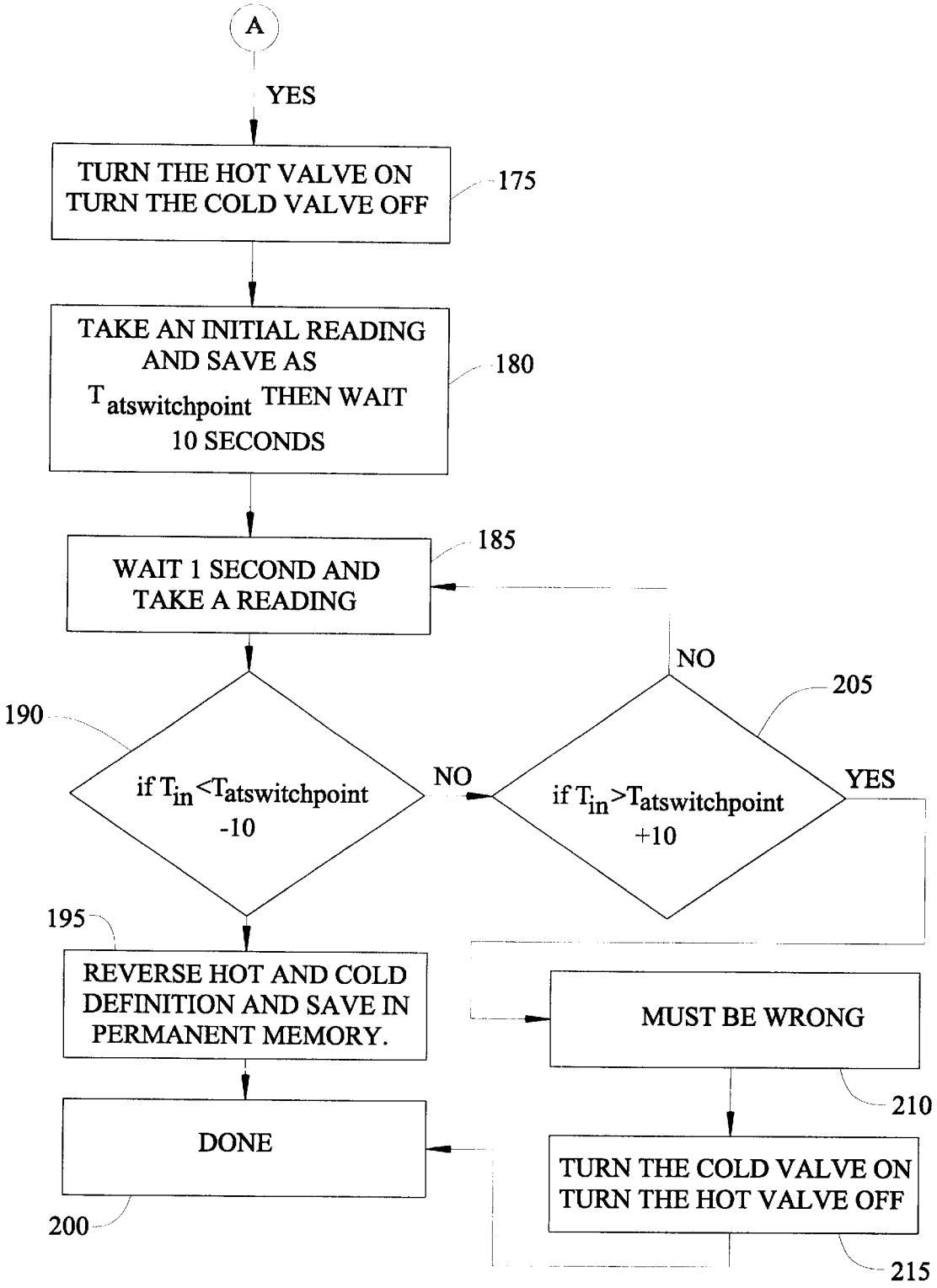

Reference will now be made to FIG. 2 in describing the preferred manner for detecting the relative attachment of hot and cold inlet water hoses 80 and 81 to washing machine 1 in accordance with the present invention. Initially it should be noted that the preferred algorithm programmed into CPU 20 in connection with detecting the relative attachment of hot and cold water hoses 80 and 81 is performed each time washing machine 1 proceeds through a predetermined washing operation. In accordance with the most preferred embodiment, the algorithm is performed every cycle that has a cold fill. In any event, in accordance with most preferred embodiment of the invention, an initial temperature reading is taken of the water currently in the supply path, i.e., downstream of hot and cold water valves 92 and 94, to washing machine 1 in step 150. Thereafter, cold water valve 94 is turned on. At this point, it should be realized that it is uncertain which hose 80, 81 is connected to washing machine 1 through cold water valve 94. Instead, it is in accordance with the invention to determine if hoses 80 and 81 have been inadvertently attached in a reverse fashion.

In any event, cold water valve 94 is turned on in step 155. After waiting a first predetermined time period in step 160, which preferably is set to be in the order of 10 seconds, the control algorithm moves to step 165. Step 165 actually constitutes an additional delay time period which, as will be detailed more fully below, also forms part of a subroutine. This additional time period is considered to be shorter than that in step 160 and, as illustrated in connection with the most preferred embodiment, only constitutes about a second.

After waiting the preset time periods set forth in steps 160 and 165, an incoming or inlet water temperature reading is taken in step 170 and a comparison is also made. More particularly, it is determined whether this inlet temperature, which is read through temperature sensor 90, is greater than each of a preset temperature and the initial temperature. In accordance with the invention, the preset temperature is established at 90° F. However, it should be realized that this preferred preset temperature could vary. It is really only important that this temperature be established at a level which would be considered to exceed any desired cold water temperature. If the sensed inlet temperature does not meet one of these criterias, the algorithm reverts back to step 165 such that, after a slight pause, a new inlet temperature reading is taken and again compared with the preset temperature and the sensed initial temperature in step 170.

If the criteria set forth in step 170 is not met, the algorithm will never leave the loop between steps 165 and 170. If the fill operation for washing machine 1 is over, the algorithm will be aborted and an assumption will be made that the hoses are correctly attached. However, if the sensed inlet temperature reading meets both of these criterias, step 175 is reached. In step 175, hot water valve 92 is turned on and cold water valve 94 is turned off. Thereafter, a new initial temperature reading is taken and saved as a switchpoint temperature in step 180. After waiting a predetermined time period in this step, which preferably is in the order of about 10 seconds, step 185 is reached. After a pause, a current inlet temperature reading is taken through sensor 90. Thereafter, it is determined whether this inlet temperature is less than the switchpoint temperature minus a predetermined temperature value in step 190. In the most preferred embodiment of the invention, this predetermined temperature value has been established as 10° F. However, it should be realized that a fair degree of variance can be employed. In any event it is important to note that the current inlet temperature being sensed is compared with a deviated value of the switchpoint temperature which has been saved in memory 65. Therefore, a test is being made in step 190 to see if the inlet water temperature is decreasing. If the sensed inlet temperature is determined to be less than the deviated value of the switchpoint temperature, step 195 is reached. Here, the established hot and cold water valve designations are reversed and saved in memory and the algorithm reaches completion step 200.

On the other hand, if the current inlet temperature as sensed in step 190 is not less than the deviated value of the switchpoint temperature, the algorithm proceeds to step 205 wherein a determination is made as to whether the inlet temperature is greater than the switchpoint temperature plus a predetermined temperature value, i.e., whether the inlet temperature is increasing. Therefore, in step 205, a new deviated switchpoint temperature is utilized in comparing with the current inlet temperature, with the deviation value being a positive 10° F. in accordance with the most preferred form of the invention. If the sense inlet temperature is not greater than the deviated switchpoint temperature in step 205, the program reverts back to step 185 wherein, following a slight pause, a new inlet temperature reading is taken with hot water valve 92 open and cold water valve 94 still closed. In this sense, if neither of the requirements of steps 190 nor 205 are met, a continual loop or subroutine constituted by steps 185, 190 and 205 will occur. Again, it is possible for this loop to maintain in tact until the fill operation is over, whereupon the algorithm would be aborted. However, if the requirements of step 190 are not satisfied, but yet the requirements of step 205 are satisfied, it is realized that the wrong valve is on. This stage of the algorithm is represented at step 210. In step 215, provisions are then taken to turn on cold water valve 94, while turning off hot water valve 92, and then proceeding directly to step 200.

As indicated above, the algorithm, as incorporated in hose reversal detection circuit 60 and represented in FIG. 2, is preferably performed periodically. Again, in accordance with the most preferred form of the invention, the hose attachment information is checked every cycle that has a cold fill. This cycle has been chosen to enhance system effectiveness based on both hot and cold water having been used so the lines are purged. If the algorithm is operated and step 200 is not reached prior to washing machine 1 being filled, the machine simply operates based on the current setting saved in memory 65. This memory can be pre-established based on assuming a correct initial hook-up of washing machine 1 or by a subsequent storage of attachment data in memory 65 through the algorithm reaching step 195 in a prior operation. Although it is indicated that the algorithm is aborted anytime a fill operation is completed, this is only true if the algorithm has not reached step 195. If the fill operation ends subsequent to reaching step 195, the reversal data will still be stored in memory 65.

Based on the above, it should be noted that the temperature of each of the hot and cold water inputs in accordance with the invention is monitored to determine if the inlet temperature is increasing or decreasing. Once the actual attachments are correctly identified, this information is stored in a permanent memory which can be used later by washing machine 1. However, the stored information is checked periodically during subsequent washing operations. It should also be realized that the algorithm is basically in a two part form for check/verification purposes. That is, if step 170 is reached and the criteria therein are met, it can be fairly assumed that hot water is entering washing machine 1. However, based on ambient conditions and prior machine operations, it is possible that this is not true such that the remaining steps in the algorithm function to verify or check this information. The same is true with respect to the portion of the algorithm including steps 175–190 and 205. Here, a determination of the decreasing/increasing nature of the water temperature could be effectively relied upon. Therefore, either of these algorithm sections could be utilized individually, but a more effective and reliable system is considered to exist when the full algorithm is employed.

Although described with reference to a preferred embodiment of the invention, it should be readily understood that various changes and/or modifications can be made to the invention without departing from the spirit thereof. For instance, although the various initial and inlet water temperatures utilized in connection with the algorithm of the present invention have been indicated to be essentially based on a single sensed temperature value, all these readings could be represented by the averaging of various samples taken sequentially over a short period of time. For instance, all the readings could be averaged with at least three samples taken through temperature sensor 90. In general, the invention is only intended to be limited by the scope of the following claims.

We claim:

1. A method of determining relative attachments of hot and cold inlet water hoses to a washing machine comprising:

establishing an initial water flow;

sensing an initial temperature;

opening a first one of hot and cold water inlet valves associated with the hot and cold inlet water hoses respectively;

allowing a first predetermined time period to lapse;

comparing a first current inlet water temperature with at least one of a predetermined temperature and the initial temperature;

opening a second one of the hot and cold water inlet valves while closing the first one;

taking a switchpoint water temperature reading;

storing the switchpoint water temperature reading;

comparing a second current inlet water temperature with a deviated value of the switchpoint water temperature; and identifying the hot and cold inlet water hoses.

2. The method according to claim 1, further comprising: comparing the first current inlet water temperature with both of the predetermined temperature and the initial temperature.

3. The method according to claim 2, further comprising: determining if the first current inlet water temperature is greater than both of the predetermined temperature and the initial temperature.

4. The method according to claim 2, wherein the predetermined temperature is approximately 90° F.

5. The method according to claim 1, further comprising: after storing the switchpoint water temperature, waiting a second predetermined time period prior to comparing the second current inlet water temperature with the deviated value of the switchpoint water temperature.

6. The method according to claim 1, wherein the deviated value of the switchpoint water temperature is less than the switchpoint temperature.

7. The method according to claim 6, further comprising: if the second current inlet water temperature is less than the deviated value of the switchpoint water temperature, establishing a reversed hot and cold inlet water hose hook-up.

8. The method according to claim 7, further comprising: saving, in electronic storage, the reversed hot and cold inlet water hose hook-up.

9. The method according to claim 6, further comprising: comparing the second current inlet water temperature with a second deviated value of the switchpoint water temperature.

10. The method according to claim 9, wherein the second deviated value of the switchpoint water temperature is greater than the switchpoint temperature.

11. The method according to claim 10, further comprising: closing the second one and opening the first one of the hot and cold water inlet valves when the second current water temperature is greater than the second deviated value of the switchpoint water temperature.

12. The method according to claim 1, wherein the deviated value of the switchpoint water temperature is greater than the switchpoint temperature.

13. The method according to claim 1, further comprising: re-identifying the hot and cold water inlet hoses each time the washing machine is operated in a cold fill.

14. The method according to claim 1, further comprising:

sensing when the washing machine reaches a desired water fill level; and terminating the method, prior to identifying the hot and cold water inlet hoses, if the washing machine reaches the desired water fill level.

15. A method of determining relative attachments of hot and cold inlet water hoses to a washing machine comprising the steps of:

a) initiating a water flow into the washing machine;

b) sequentially monitoring temperatures of hot and cold water inputs;

c) making a determination of whether at least one of the temperatures is increasing or decreasing;

d) establishing an identity of the hot and cold water hoses based on the determination; and e) storing the identity of the hot and cold water hoses.

16. The method according to claim 15, further comprising:

sensing an initial water temperature; and determining if a temperature of one of the hot and cold water inputs is greater than both a preset temperature and the initial water temperature.

17. The method according to claim 15, further comprising:

sensing an initial water temperature; and subsequently determining if a temperature of one of the hot and cold water inputs is increasing or decreasing through a comparison with at least one deviated value of the initial water temperature.

18. The method according to claim 17, further comprising:

establishing first and second deviated values of the initial water temperature; and comparing the temperature of the one of the hot and cold water inputs with each of the first and second deviated values.

19. The method according to claim 15, further comprising: re-establishing the identity of the hot and cold water inlet hoses each time the washing machine is operated in a cold fill.

20. The method according to claim 15, further comprising:

sensing when the washing machine reaches a desired water fill level; and terminating the method, prior to identifying the hot and cold water inlet hoses, if the washing machine reaches the desired water fill level.

* * * * *